US009004477B2

(12) United States Patent
Neumann et al.

(10) Patent No.: US 9,004,477 B2
(45) Date of Patent: Apr. 14, 2015

(54) SAW BUCK

(76) Inventors: Chad M. Neumann, Ann Arbor, MI (US); Michael V. Rzeppa, Marine City, MI (US)

( * ) Notice: Subject to any disclaimer, the term of this patent is extended or adjusted under 35 U.S.C. 154(b) by 456 days.

(21) Appl. No.: 13/460,064

(22) Filed: Apr. 30, 2012

(65) Prior Publication Data

US 2012/0274013 A1 Nov. 1, 2012

Related U.S. Application Data

(62) Division of application No. 29/390,599, filed on Apr. 27, 2011, now Pat. No. Des. 658,549.

(51) Int. Cl.

| | |
|---|---|
| ***B25H 1/06*** | (2006.01) |
| ***B27B 21/00*** | (2006.01) |
| ***B27B 17/00*** | (2006.01) |

(52) U.S. Cl.

CPC *B25H 1/06* (2013.01); *B27B 21/00* (2013.01); *B27B 17/0075* (2013.01)

(58) Field of Classification Search

USPC ..... 269/287, 296; 224/502, 519

See application file for complete search history.

(56) References Cited

U.S. PATENT DOCUMENTS

| | | | | |
|---|---|---|---|---|
| 3,000,627 | A * | 9/1961 | Foote, Jr. | 269/70 |
| 4,173,237 | A * | 11/1979 | Heikkinen et al. | 144/4.6 |
| D266,274 | S * | 9/1982 | Arns | D25/67 |
| 4,362,295 | A * | 12/1982 | Ford | 269/69 |
| 4,468,018 | A * | 8/1984 | Vaizey | 269/54.5 |
| D279,661 | S | 7/1985 | Heard | |
| 4,535,980 | A * | 8/1985 | Jordan | 269/102 |
| 4,676,490 | A * | 6/1987 | Hopkins | 269/53 |
| 4,718,652 | A | 1/1988 | Liebenstein | |
| 5,072,918 | A * | 12/1991 | Campbell | 269/296 |
| 5,232,259 | A * | 8/1993 | Booker | 296/37.6 |
| 5,472,180 | A * | 12/1995 | Bent | 269/99 |
| 5,632,475 | A | 5/1997 | McCanse | |
| D485,516 | S | 1/2004 | McCoy et al. | |
| 7,090,287 | B1 * | 8/2006 | Eberst | 296/180.1 |
| 7,131,676 | B2 * | 11/2006 | Hoff | 294/17 |
| 7,591,404 | B2 * | 9/2009 | LeDuc et al. | 224/509 |
| D612,774 | S | 3/2010 | Gordon | |
| D643,272 | S * | 8/2011 | Casteel | D8/72 |
| 2010/0156018 | A1 * | 6/2010 | Maire | 269/296 |
| 2011/0291339 | A1 * | 12/2011 | Yu et al. | 269/59 |

FOREIGN PATENT DOCUMENTS

| | | | |
|---|---|---|---|
| EP | 0064480 | A2 | 11/1982 |

* cited by examiner

*Primary Examiner* — Lee D Wilson
*Assistant Examiner* — Henry Hong
(74) *Attorney, Agent, or Firm* — Harness, Dickey & Pierce, P.L.C.

(57) ABSTRACT

An apparatus for holding a log or similar material during cutting is disclosed. The apparatus includes a log holder having a housing and a saddle. A cavity formed in the housing is tapered along a longitudinal axis for receiving an end of a log. The saddle is disposed adjacent to the tapered cavity and offset from the longitudinal axis to inhibit rotation of the log during cutting. A pole and a base rotatably support the log holder in the elevated position.

14 Claims, 3 Drawing Sheets

SAW BUCK

CROSS-REFERENCE TO RELATED APPLICATIONS

This application is a continuation-in-part of U.S. Design Patent Application No. 29/390,599, filed on Apr. 27, 2011. The entire disclosure of the above application is incorporated herein by reference.

FIELD

The present disclosure relates to an apparatus for holding a material during cutting and, more particularly, a saw buck.

BACKGROUND

This section provides background information related to the present disclosure which is not necessarily prior art.

Numerous prior art saw bucks are designed to hold material during a cutting operation. However, these designs often involve clamping or chaining down the material prior to cutting. Some saw bucks hold the material in a midpoint, impeding cutting in the middle of the material and requiring shifting the material as it is cut to remain balanced on the saw buck.

Accordingly, there is a need in the art to provide a saw buck which holds material such as a log at an end without requiring additional fastening prior to cutting.

SUMMARY

This section provides a general summary of the disclosure, and is not a comprehensive disclosure of its full scope or all of its features.

As further set forth in detail below, this disclosure provides an apparatus for holding a material during cutting having an elongated support extending from an elevated portion. The elevated portion includes a saddle member disposed adjacent to a tapered cavity adapted to receive an end of the material.

In general, the apparatus includes a log holder having a housing defining a cavity. The cavity is generally tapered along a longitudinal axis such as a truncated pyramid or truncated cone but may take any other suitable tapered geometric form. An opening in the housing is operable to receive an end of a log or similar material. A saddle is disposed adjacent to the opening. A pole extends from the log holder and supports the log holder in an elevated position on a base. The pole is rotatably coupled to the base so that the log holder is free to rotate about the axis of the pole.

In an embodiment, the log housing defines a first planar member having a first major face and a second planar member having a second major face angularly aligned with respect to the first major face to define the tapered cavity. In an embodiment, the base is a stationary plate. In another embodiment, the base is configured to be used with a receiver hitch on a vehicle. The saddle may be configured as a V-shaped member, a U-shaped member or a semicircular member for constraining the log. The saddle and a surface of the housing within the cavity may have a textured surface formed thereon for gripping the log.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
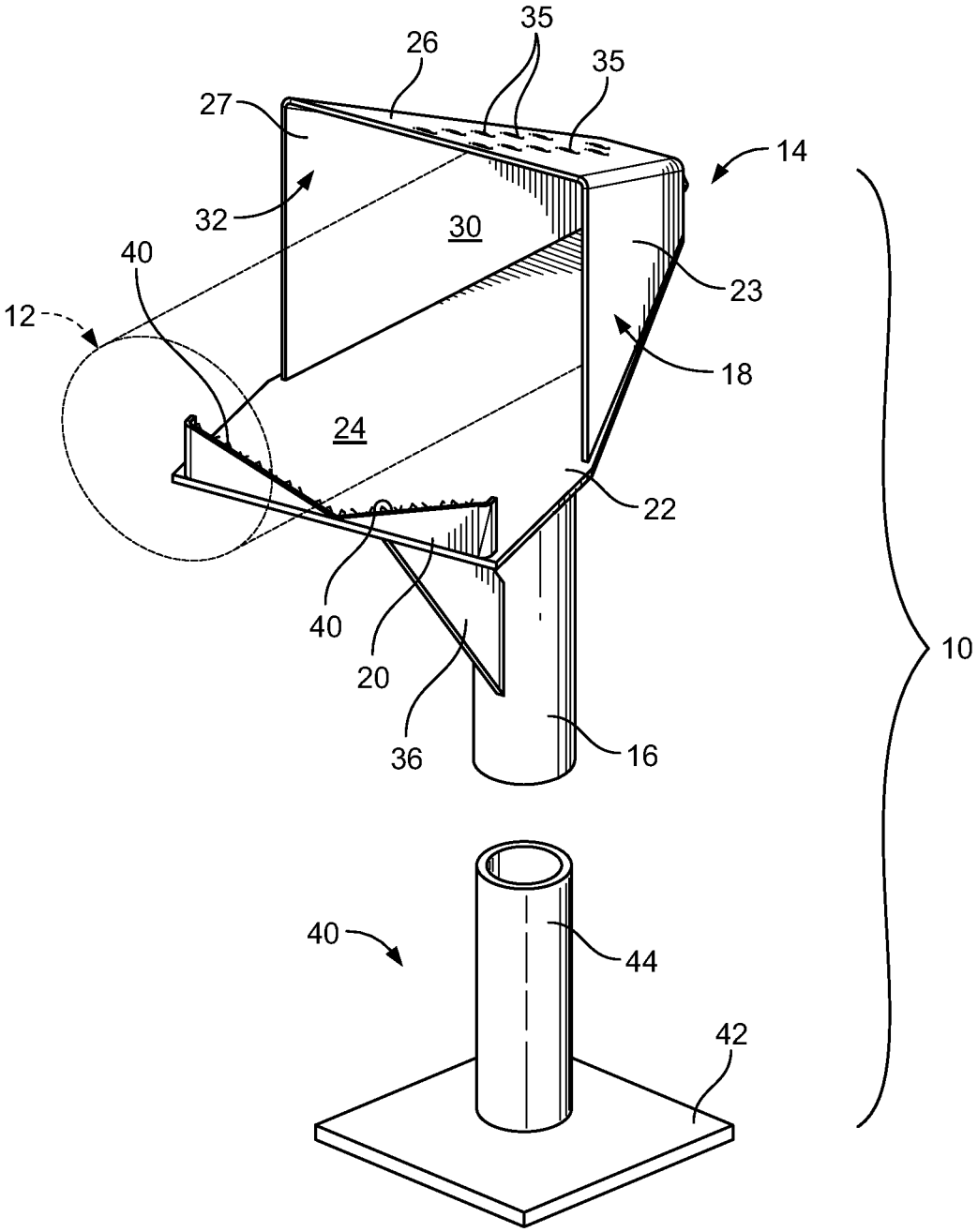
FIG. 1 is a perspective view of a saw buck with a stationary base holding a log shown in broken lines.
Figure 2:
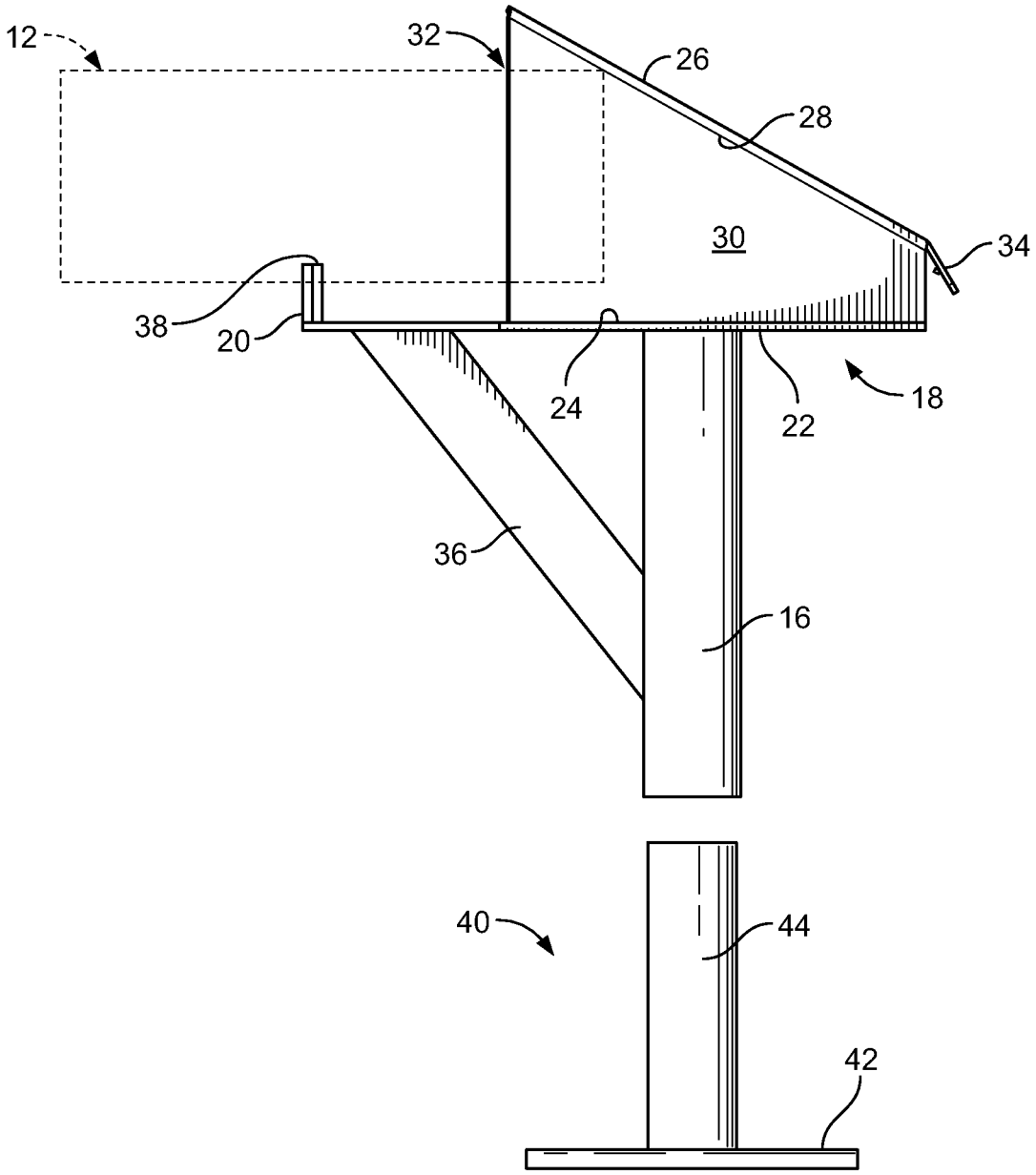
FIG. 2 is a cross sectional view of a saw buck taken.

FIGS. 1 and 2 illustrate a saw buck 10 supporting a log 12 or similar material in a cantilevered manner. As such, a free end of the log 12 opposite the saw buck 10 is readily accessible for cutting. Saw buck 10 generally includes a log holder 14 and a pole 16 extending from the log holder 14. The components for the saw buck 10 are preferably constructed with metal (e.g., steel) but may also include high strength plastic or polymer components, a composite components or components constructed with other suitable material.

The log holder 14 includes a housing 18 disposed adjacent to a saddle 20. The housing 18 includes a first planar member 22 having a first major face 24. A second planar member 26 having a second major face 28 is angularly aligned with respect to the first major face 24. Sidewalls 23, 27 extend between the first and second planar members 22, 26 which collectively define a tapered cavity 30. The cavity 30 is accessible through an opening 32 at one end of the housing 18. As shown, the tapered cavity 30 is in the form of a truncated pyramid and adapted for receiving an end of the log 12. While the pyramidal shape is presently preferred, one skilled in the art will recognize that the tapered cavity may take other tapered forms such as a truncated cone or other shape having a tapered cavity formed therein.

The second planar member 26 has a tab 34 extending downwardly towards the first planar member 22. The second planar member 26 has a textured surface formed by a set of protrusions 35 formed therein and extending into the cavity 30 for gripping the log 12. While protrusions 35 are shown, one skilled in the art will recognize that other features may be used to provide this gripping function such as a textured surface, internal teeth or a high static friction coating. A brace 36 extends from the pole 16 to the bottom of the second planar member 26 to provide support and rigidity to the log holder 14.

The saddle 20 is disposed adjacent an opening 32 in the housing 18. The saddle 20 is generally perpendicular to the first planar member 22. An edge 38 of the saddle 20 is elevated above the first planar element 22 adjacent to the opening 32 of the tapered cavity 30. The log 12 is supposed in a cantilevered manner from the log holder 14 with the end of the log 12 inserted into cavity 30 and contacting the saddle edge 38. In this way, the saddle 20 functions to support the log 12 while preventing rotation thereof.

As illustrated in the figures, the saddle edge 38 has a set of teeth 40 (shown in FIG. 1) formed thereon for biting into the log. Other means for increasing the static friction on the contact edge of the saddle may be used such as a textured surface or other high static friction coating. The saddle 20, and in particular, the saddle edge 38 is preferably configured in a V-shape, a U-shape, or a semicircular shape to prevent rotation of the log 12.

The pole 16 extends from the log holder 14 and is adapted to connect to a stationary base 40. The stationary base 40 includes a base plate 42 and a pipe 44. The pipe 44 has an outer diameter sized to be slidably coupled with the pole 16. As illustrated in FIGS. 1 and 2, the outer diameter of the pipe 44 is sized to be received within the inner diameter of the pole 16. In this way, the log holder 14 is supported in an elevated position and is rotatable through 360°. Alternately, the inner diameter of the pipe 44 may be sized to receive the outer diameter of the pole 16. The base member 38 may be used to attach the saw buck 10 to a stationary object to retain the position of the saw buck 10. For example, the base member 38 may attach the saw buck 10 to the ground, a structure such as a deck or platform, a vehicle such as a truck bed or trailer, or other rigid object.

Figure 3:
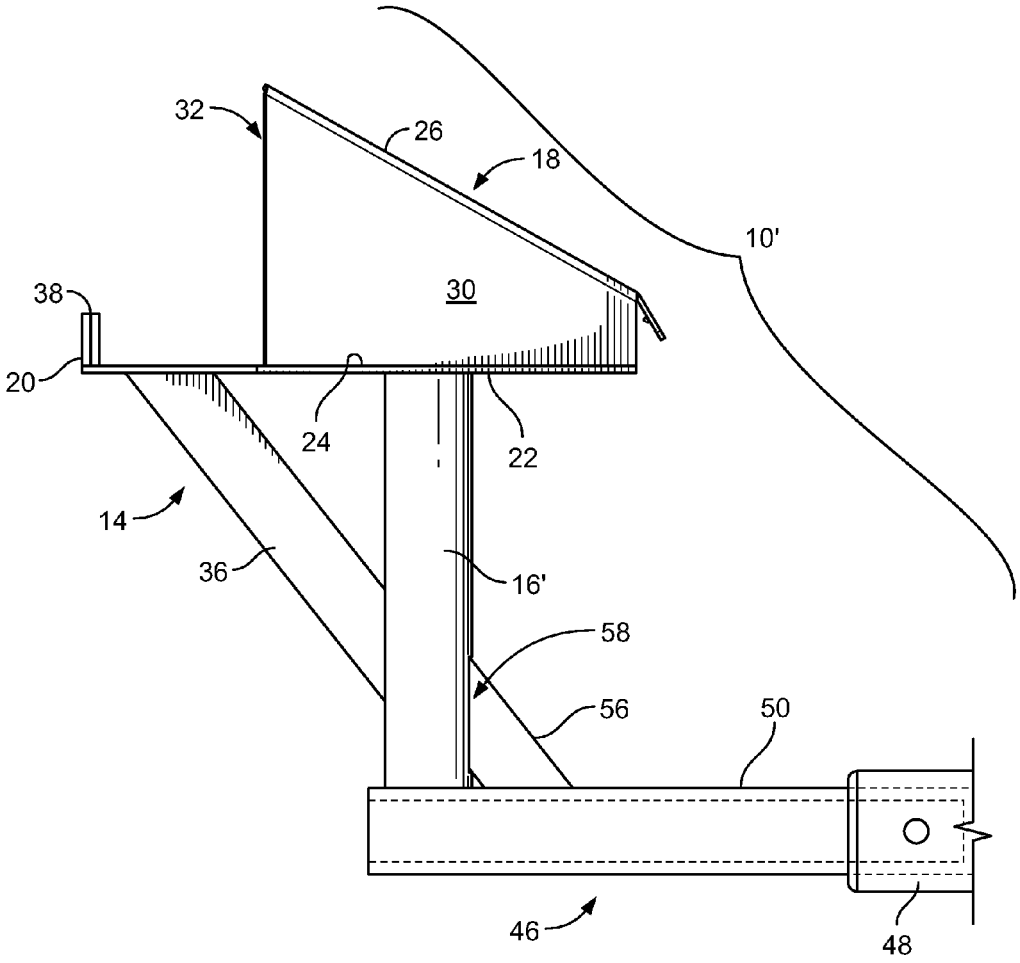
FIG. 3 is a side elevation view of a saw buck with a base adapted to attach to a receiver hitch on a vehicle.
Figure 4:
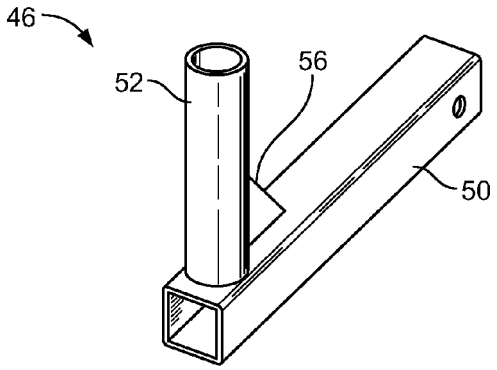
FIG. 4 Is a perspective view of the base shown in FIG. 3.

Referring now to FIGS. 3 and 4, an alternate embodiment of the saw buck 10' is illustrated having a vehicle hitch base 46 adapted to attach to a receiver hitch 48 on a vehicle (not shown). The vehicle hitch base 46 has a beam 50 extending generally horizontal from the receiver hitch 48. A pipe 52 extends generally perpendicular from the beam 50 at an end opposite the receiver hitch 48. As illustrated, the outer diameter of the pipe 52 is sized to be received within the inner diameter of the pole 16'. The length of the beam 50 may vary greatly to accommodate various uses; for instance, operating the saw buck while a pick-up gate is raised and lowered. A web 56 extends angularly from beam 50 to the pipe 52 to improve the stiffness of the joint therebetween. A cutout 58 is formed in the bottom of pole 16' to provide clearance for the web 56. The cutout 58 may be oversize relative to the thickness of the web 56 to permit a degree of rotation of the saw buck 10' on the vehicle hitch base 46.

The embodiments set forth above are provided so that this disclosure will be thorough, and will fully convey the scope of the apparatus to those who are skilled in the art. Various details are set forth such as examples of specific components and devices to provide a thorough understanding of embodiments of the present disclosure. It will be apparent to those skilled in the art that specific details need not be employed, that example embodiments may take various forms and that neither should be construed to limit the scope of the disclosure.

When an element or component is referred to as being "on," "engaged to," "connected to," "coupled to", or "between" another element or component, it may be directly or indirectly on, engaged, connected, coupled to or between the other element or component. Although the terms first, second, third, etc. may be used herein to describe various elements or components, these elements and/or components should not be limited by these terms. These terms may be only used to distinguish one efrom another. Likewise, terms such as "first," "second," and other numerical terms when used herein do not imply a sequence or order unless clearly indicated by the context. Thus, a first element or component could be termed a second element or component without departing from the teachings of the examplar.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An apparatus for holding a material during cutting comprising:

a log holder including a housing having a frustum-shaped cavity with an opening operable to receive an end of a log, and a saddle disposed adjacent to the opening;

a pole extending from the log holder and supporting the log holder in an elevated position, and a base rotatably connected on an end of the pole opposite the log holder for rotatably supporting the log holder in the elevated position, wherein a contact surface of the saddle comprises a textured surface, the textured surface comprises a set of teeth form on an edge of the saddle.

2. The apparatus of claim 1, wherein the saddle is selected from the group consisting of a V-shaped member, a U-shaped member, and a semicircular member.

3. The apparatus of claim 1, wherein an interior surface of the housing has a textured surface.

4. The apparatus of claim 3, wherein the textured surface comprises a set of protrusions extending from the interior surface into the cavity.

5. The apparatus of claim 1 wherein the base comprises a base plate and a pipe extending from the base plate, wherein the pipe is to slidably coupled with the pole.

6. The apparatus of claim 1 wherein the base comprises a beam and a pipe extending generally perpendicular from the beam, wherein the pipe is to slidably coupled with the pole.

7. The apparatus of claim 6, wherein the beam is sized to cooperate with a vehicle receiver hitch.

8. An apparatus for holding a log during cutting comprising:

a log holder including a first planar member having a first major face, a second planar member having a second major face angularly aligned with respect to the first major face to define a tapered cavity;

a saddle disposed at an edge of the first planar member opposite the tapered cavity, a contact surface of the saddle comprises a textured surface, the textured surface comprises a set of teeth form on an edge of the saddle;

a pole extending from the log holder and supporting the log holder in an elevated position; and a base pivotally connected to an end of the pole opposite the log holder for rotatably supporting the log holder in the elevated position.

9. The apparatus of claim 8, wherein the saddle is selected from the group consisting of a V-shaped member, a U-shaped member, and a semicircular member.

10. The apparatus of claim 8, wherein an interior surface of the housing has a textured surface.

11. The apparatus of claim 10, wherein the textured surface comprises a set of protrusions extending from the interior surface into the cavity.

12. The apparatus of claim 8 wherein the base comprises a base plate and a pipe extending from the base plate, wherein the pipe is to slidably coupled with the pole.

13. The apparatus of claim 8 wherein the base comprises a beam and a pipe extending generally perpendicular from the beam, wherein the pipe is to slidably coupled with the pole.

14. The apparatus of claim 13, wherein the beam is sized to cooperate with a vehicle receiver hitch.

* * * * *